US005370019A

United States Patent [19]

Sartell et al.

[11] Patent Number: 5,370,019

[45] Date of Patent: Dec. 6, 1994

[54] JAR LID REMOVER

[76] Inventors: M. Kevin Sartell, 145 Meetinghouse La., Dover, Del. 19901; Craig A. Moore, 159 Ed Moore Rd., Elkton, Md. 21921; Ed G. Mahler, 27 Madison Dr., Newark, Del. 19711

[21] Appl. No.: 179,326

[22] Filed: Jan. 10, 1994

[51] Int. Cl.[5] ..... B67B 7/14

[52] U.S. Cl. ..... 81/3.32; 81/3.2

[58] Field of Search ..... 81/3.2, 3.25, 3.31, 81/3.32

[56] References Cited

U.S. PATENT DOCUMENTS

| | | | |
|---|---|---|---|
| 1,689,301 | 10/1928 | Ryckman | 81/3.32 |
| 2,761,337 | 9/1956 | Daniel | 81/3.25 |
| 3,159,064 | 12/1964 | Woloszyn | 81/3.32 |
| 3,795,158 | 3/1974 | Morita . | |
| 3,812,742 | 5/1974 | Polasek . | |
| 3,950,801 | 4/1976 | Morrison . | |
| 4,102,226 | 7/1978 | McGuire | 81/3.32 |
| 4,171,650 | 10/1979 | Cardinal . | |
| 4,766,781 | 8/1988 | Grise . | |

*Primary Examiner*—D. S. Meislin

*Attorney, Agent, or Firm*—Richard C. Litman

[57] ABSTRACT

A powered jar lid remover includes a work table supporting a rotatable platen, an electric motor with associated drive and manual on-off switch, and a clamp disposed above the platen. The platen rides on plungers which, in turn, ride on a cammed track disposed beneath the platen. A jar placed on the platen is urged into progressively tighter engagement of the clamp when the platen rotates, and ascends a ramp formed in the cammed track. The clamp has a friction brake opposing upward movement, so that the jar cannot defeat clamping action by pushing the clamp upwardly. A manual lever releases the brake so that the clamp can be moved upwardly for adjustment, as for accommodating a jar of greater height. The brake opposes upward movement only, and downward movement of the clamp is unopposed by the brake.

11 Claims, 3 Drawing Sheets

FIG. 4
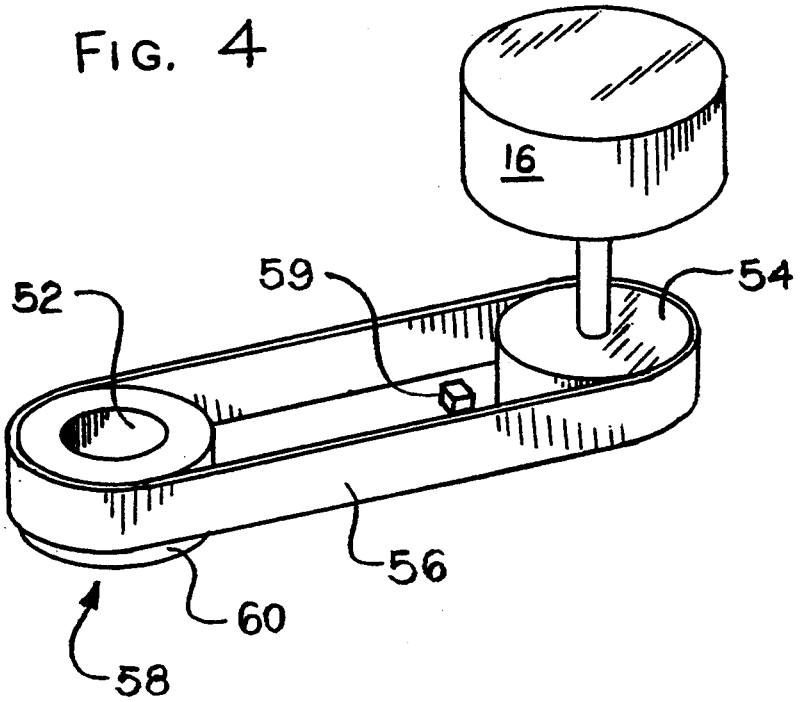
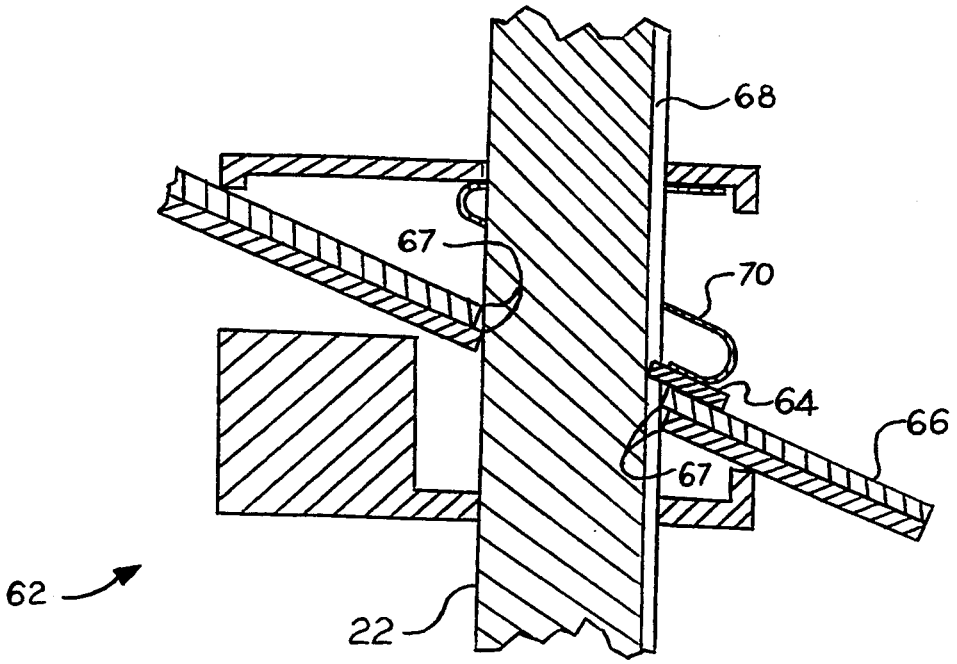
FIG. 5

JAR LID REMOVER

BACKGROUND OF THE INVENTION

1. FIELD OF THE INVENTION

The present invention relates to a powered machine for automatically removing screw-on lids from jars.

2. DESCRIPTION OF THE PRIOR ART

Jars are commonly employed to contain household materials, particularly foodstuffs, for convenient storage and retrieval. Jars are usually equipped with thin, metallic lids, which attach to the jars by cooperating threads. For many reasons, a lid can be so tightly fitted to its associated jar that removing the same becomes a difficult task for a person attempting to open the jar. For example, a lid may be very tightly installed in the manufacturing process. Also, entrapment of fluent contents on the threads may cause the lid to stick in its tightened position. Corrosion of the lid may also cause sticking.

Even in those cases wherein the effort of unscrewing a lid is within generally accepted limits, some people are not strong enough to accomplish this task. Examples include the very young, persons with arthritis, the elderly, and those with injury to a hand or arm.

To assist persons who for whatever reason need such assistance in opening a jar, machines for unscrewing lids from jars have been proposed in the prior art. As these machines are typically intended for tabletop use, they frequently include a base having a vertical shaft on which is mounted a gripping device for holding a jar by its lid. The gripping device is disposed above a second gripping device located on the base, with the jar sandwiched between opposing gripping devices.

One of the top or bottom gripping devices is provided with rotation means, the other gripping device being immobile, so that a torque is imparted to the jar. This torque is intended to break a seal, or initial resistance, securing the lid to the jar.

U.S. Pat. No. 4,171,650, issued to John Cardinal on Oct. 23, 1979, discloses a jar lid removing machine wherein operation automatically draws opposing gripping devices toward one another by raising the jar on a movable table. The table has a member threaded to a rotatable screw. As the screw turns, the table rises in response thereto. Excessive clamping force is avoided by a torque clutch disposed in line between the screw and its associated drive motor.

U.S. Pat. No. 3,812,742, issued to Emil Polasek on May 28, 1974, discloses another motorized jar opener which holds the jar between a stationary lower friction gripping device and an upper, rotatable gripping device. The upper gripping device is motorized. A pair of lever arms adjustably hold the jar from the sides. A manually operated arm bears down on the upper gripping device, thus assuring that the lid does not slip relative to the upper gripping device.

U.S. Pat. Nos. 3,795,158, issued to Robert Y. Morita on Mar. 5, 1974, and 3,950,801, issued to Howard J. Morrison on Apr. 20, 1976, disclose typical jar lid removing machines. Each of these two inventions provides a manually operated, vertical locking device holding the jar clamped between upper and lower gripping devices.

A hand held accessory for gripping a jar lid is seen in U.S. Pat. No. 4,766,781, issued to Frederick G. J. Grise et al. on Aug. 30, 1988. This device does not support and hold a jar unassisted, and is not powered.

None of the above inventions and patents, taken either singly or in combination, is seen to describe the instant invention as claimed.

SUMMARY OF THE INVENTION

The present invention provides an opener for removing lids from jars. An advantageous specific application is removing security lids from medicine containers. The novel lid remover includes a work table, an upper clamp slidably mounted on a vertical shaft, and a rotatable lower clamp mounted on the work table. In typical fashion, a jar is placed on the lower clamp, hereinafter referred to as a platen, and beneath the upper clamp.

The upper clamp is manually adjusted for varying heights of different jars, but contact and precise initial torque setting are not required, as is preferable in most prior art jar lid removers. This requirement is met by a circular track on which the platen is supported. The track has a cammed upper surface, thus forcing the platen upwardly while being rotated. This applies progressively increasing upward force to the jar, thereby avoiding torsional slippage.

The cammed track is an important feature, since it provides automatic adjustment and progressive increase of torque bearing on the jar lid. The user no longer must set the upper clamp with great precision, and need not set nor adjust the degree of torque.

Therefore, appropriate gripping power is applied to the jar, and the upper clamp avoids torsional slippage, which would defeat unscrewing of the lid.

The apparatus for adjusting height of the upper clamp includes a brake which frictionally opposes upward sliding. A finger projecting from the brake at an inclination rides in a groove formed in the vertical shaft. The finger is biased into engagement with the shaft, and will oppose rotational movement of the upper clamp about the vertical shaft. A manual release lever enables repositioning the upper clamp when desired.

Thus, the height of the upper clamp is readily reset to accommodate a new jar of different height.

These performance characteristics render the present invention suitable for use by a selected user group which suffers from arthritis. The arthritic condition causes pain to the joints, thus making it desirable not only to provide necessary power to break a lid free, but also to minimize as much manipulation of a jar as is feasible. This user group is generally otherwise self-sufficient, and would benefit greatly if obstacles to coping with tight jar lids were overcome.

It has been determined by the applicants that most jars employed in the household are limited in dimension to heights up to 12 inches (30 cm), diameters up to 6 inches (15 cm), and have lid diameters usually not exceeding 3.5 inches (9 cm).

Accordingly, it is a principal object of the invention to provide an apparatus for automatically unscrewing the lid of a jar which apparatus minimizes operational steps demanded of a user.

It is another object of the invention to provide automatic adjustment of the clamping force bearing on the jar.

It is a further object of the invention to provide a jar lid removing apparatus which is manually adjusted to accommodate jars of different heights.

Still another object of the invention is to increase clamping force progressively and automatically.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

FIG. 4 is a perspective detail view of drive components, isolated from, the invention, and drawn to enlarged scale.

FIG. 5 is a diagrammatic, cross sectional detail view taken from the upper right of FIG. 1.

Similar reference characters denote corresponding features consistently throughout the attached drawings.

DETAILED DESCRIPTION OF THE PREFERRED EMBODIMENT

Figure 1:
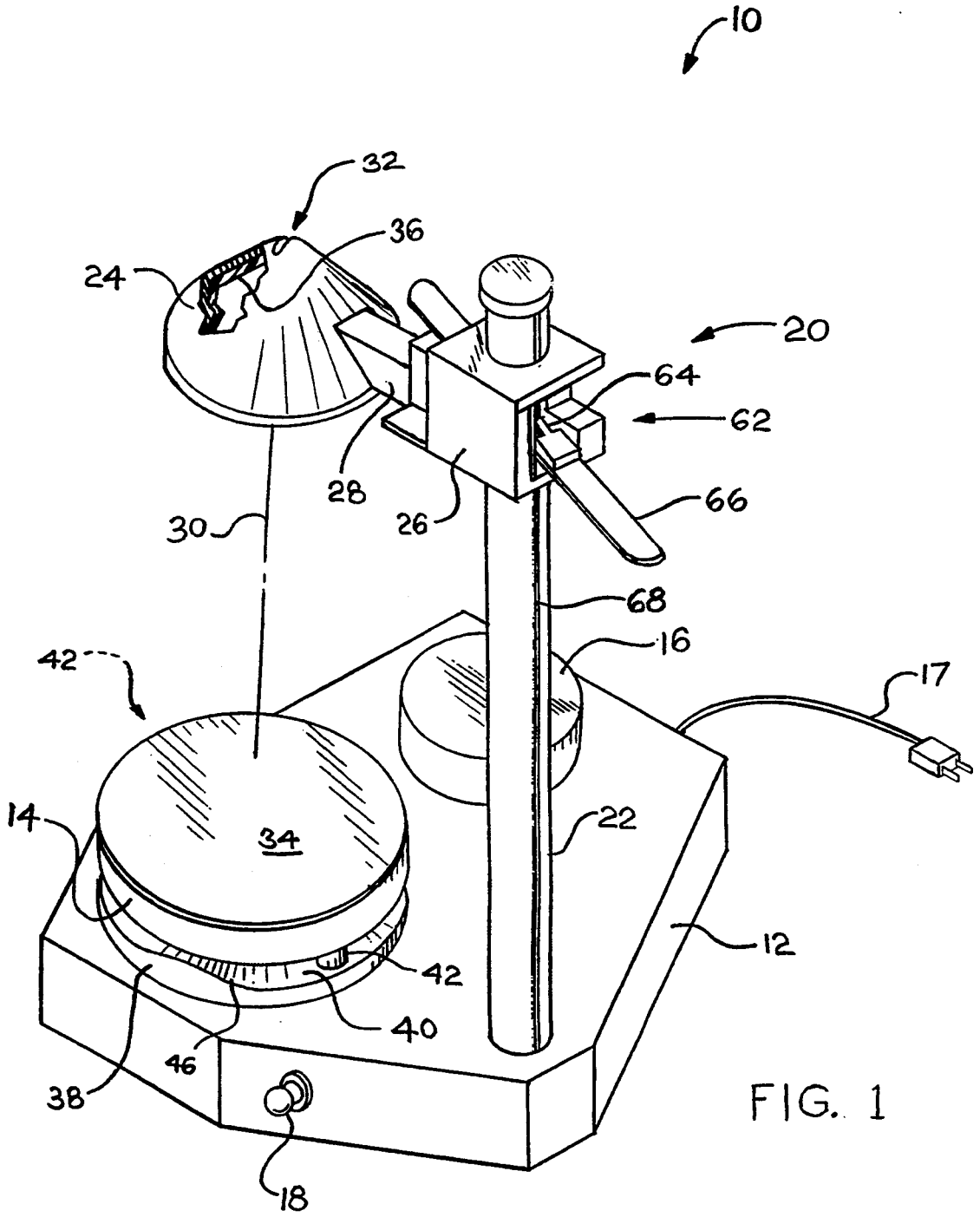
FIG. 1 is a perspective, partial fragmentary diagrammatic view of the invention.

The jar lid remover 10 of the present invention is seen in FIG. 1 to have a work table or base 12 which sits on an environmental surface (not shown), such as a counter top. Supported on and attached to base 12 are platen 14 and associated drive and support components, motor 16 and control switch 18, and a tower mounted stop assembly 20. Stop assembly 20 comprises a vertical shaft 22 to which a stop cap 24 is slidably attached.

Platen 14 rotates in response to operation of an electric motor 16, which derives its power from a suitable electric source (not shown) by a standard power cord 17. Motor 16 is controlled by switch 18 mounted to base 12. Switch 18 is arranged to cause motor 16 to run. Although the same switch 18 may be arranged to stop motor 16 as well as to start and maintain operation of the same, it is preferred that a limit switch 59 (see FIG. 4) be employed to stop motor 16. If it is desired to secure a lid to the jar for sealing, switch 18 and motor 16 could be arranged to operate in both clockwise and counterclockwise directions. Both unidirectional and bidirectional operation are well known, and the circuitry therefor need not be further discussed here.

A jar (not shown) is placed on platen 14, and is secured between platen 14 and stop cap 24, is and held in this orientation by the following arrangement. A carriage 26 surrounds the circumference of vertical shaft 22, and slides up and down therealong. Carriage 26 supports stop cap 24 on an arm 28 such that stop cap 24 is disposed in vertical registry with platen 14. This is indicated by axis 30, which is common to both stop cap 24 and platen 14.

Stop cap 24 is preferably conical and rigid, so that jar lids of different diameters will establish contact therewith, and be held securely thereby when urged upwardly thereagainst. A slot 32 is formed at the top of stop cap 24, so that a jar lid which becomes lodged therein after removal from its jar can be dislodged by insertion of a rod or tool blade (not shown).

Platen 14 is covered by a liner 34 of material which is preferably resilient, and possessing high coefficient of friction. Rubber, and plastics having similar properties, are exemplary of suitable materials.

Stop cap 24 has a second liner 36, also made from rubber or the like. Liner 36 follows the conical contour of stop cap 24, as will be seen from the fragmentary cross section included in the view of FIG. 1. A jar is gripped by resilient and frictional surfaces of liners 34 and 36 by clamping action which will now be described.

Platen 14 is seen to be disposed above a track 38 having a cammed upper surface 40. Platen 14 rides on at least two plungers 42 (one visible in this view). These components are seen in greater detail in FIG. 2.

Figure 2:
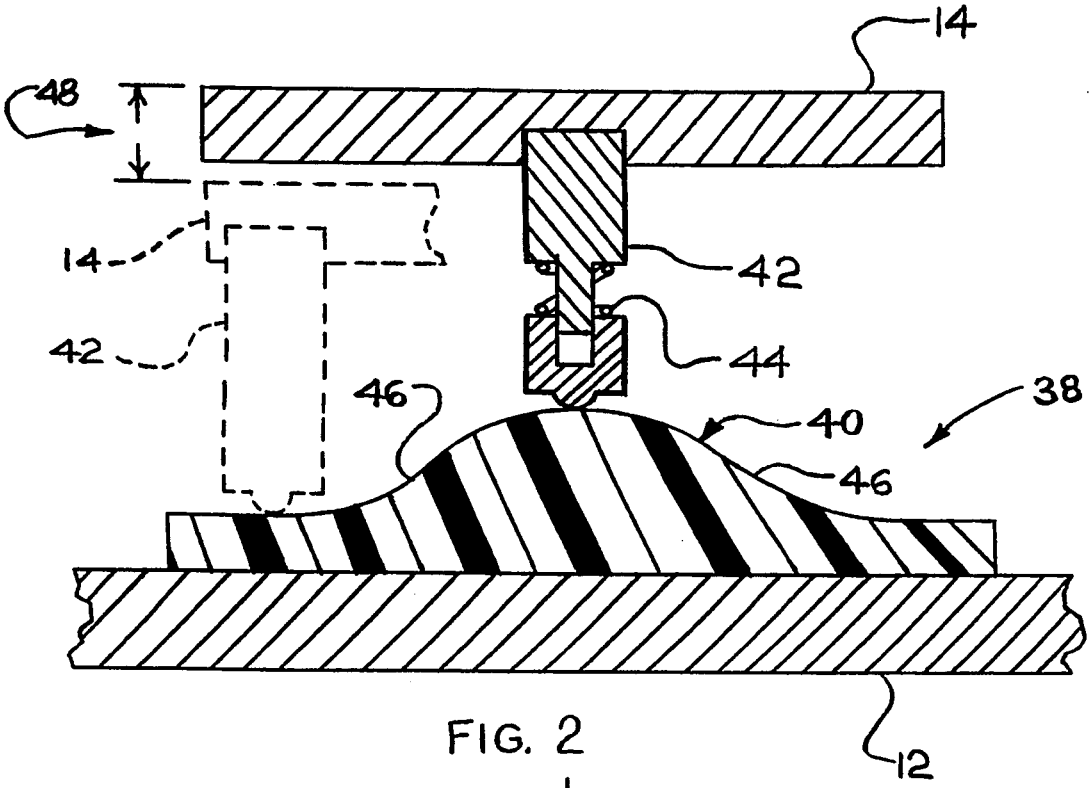
FIG. 2 is a diagrammatic, cross sectional detail view taken from the lower left of FIG. 1, and drawn to enlarged scale.

Plunger 42 is secured to platen 14, as by friction fit. Plunger 42 is formed in two mutually engaged parts, with a spring 44 disposed between the two parts. FIG. 2 shows plunger 42 and platen 14 at an uppermost attainable position, plunger 42 having ascended a ramp 46 formed in track 38.

Track 38 is fixed solidly to base 12, beneath platen 14. Each plunger 42 is constrained to follow cammed surface 40 as platen 14 rotates. Plunger 42 and platen 14 lower when plunger 42 descends ramp 46. Resultant low position of plunger 42 and platen 14 is shown in broken lines in the view of FIG. 2, and the displacement from the uppermost position is indicated at 48.

Preferably, two or more plungers 42 and an equal number of high points on cammed surface 40 are provided. This avoids asymmetrical loads being imposed on platen 14 about axis 30 (see FIG. 1).

Figure 3:
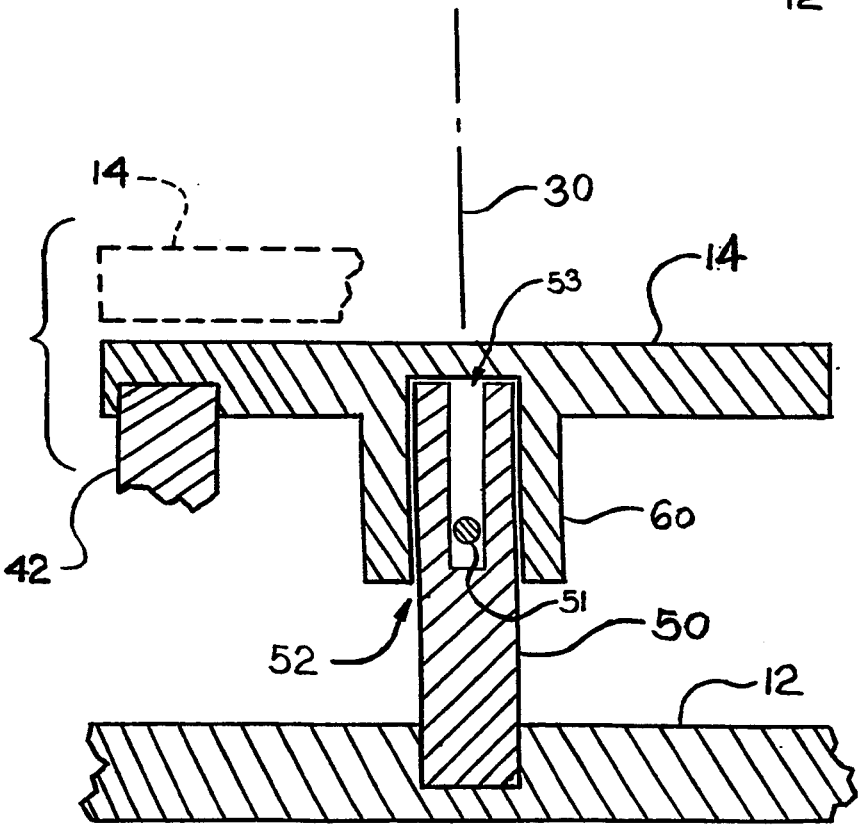
FIG. 3 is a diagrammatic, cross sectional detail view taken from the lower left of FIG. 1, and drawn to enlarged scale.

Turning now to FIG. 3, platen 14 is constrained to rotate about axis 30 by interfit with a guide rod 50. A pin 51 anchored in platen 14, as by opposed bores (not shown) which penetrate pulley 58 which includes outer surface 60, rides in a slot 53 milled in guide rod 50. Platen 14 may move upwardly and downwardly in response to cammed surface 40, pin 51 moving accordingly within slot 53, while platen 14 is thereby constrained to rotate in lockstep with guide rod 50.

Separation of walls of a bore 52 formed in platen 14 from guide rod 50 is exaggerated for clarity. Guide rod 50 is firmly supported within base 12. Bore 52 is sufficiently deep to accommodate uppermost and lowermost positions of platen 14. In this view, platen 14 is illustrated at a lowermost position, an uppermost position being indicated in broken lines.

FIG. 4 shows drive components isolated from jar lid remover 10. Motor 16 turns a pulley 54. A satisfactory motor is provided by a gear motor manufactured by Merkle-Korff, model QF. This motor provides 75 inch-pounds (0.86 Nm) of torque, thereby exceeding a minimal preferred value of 50 inch-pounds (0.58 Nm). A belt 56 transmits torque to a second pulley 58. Pulley 58 is formed integrally with or is solidly fixed to platen 14 (see FIG. 1). In either case, bore 52 passes through pulley 58.

A limit switch 59 shuts off the motor after 360 degrees of rotation to prevent unnecessary operation.

Pulley 58 includes outer surface 60, which has a height dimension greater than a corresponding dimension of surrounding belt 56. As platen 14 rotates, belt 56 contacts outer surface 60 at varying points therealong. Thus, motor 16 and pulley 54 rotate, but are axially immobile. Upward and downward movement of platen 14 is accommodated by height of outer surface 60.

Again referring to FIG. 1, carriage 24 slides downwardly with relative ease, coming to rest on the lid (not shown) of the jar placed in jar lid remover 10.

Corresponding upward movement of stop cap 24, which would otherwise occur in response to platen 14 ascending a ramp 46, and causing a jar to push upwardly on stop cap 24, is opposed by a brake assembly 62. This arrangement ensures grip of a jar lid by stop cap 24.

As seen in FIG. 5, brake assembly 62 includes a finger 64 fastened to a lever 66. Finger 64 rides at an inclination in a groove 68 formed in vertical shaft 22, and prevents mutual rotation between carriage 24 and vertical shaft 22. This assures that stop cap 24 and platen 14 (see FIG. 1) are always aligned. A spring 70 formed integrally with finger 64 biases finger 64 into contact with vertical shaft 22. When carriage 24 (see FIG. 1) moves downwardly, inclination enables finger 64 to slide with little friction along vertical shaft 22. However, upward motion of carriage 24 causes lever 66 to bind against vertical shaft 22 at steps 67 formed in lever 66. Lever 66 therefore provides a braking member which opposes upward movement and allows downward movement of carriage 24, which carriage 24 acts in the capacity of one member of a clamp. Therefore, carriage 24 is readily lowered, but spontaneous or unintended upward motion which would defeat operation of jar lid remover 10 is prevented.

When carriage 24 is intentionally moved upwardly, as would be required to remove the jar or to accommodate a tall jar, lever 66 is depressed. This action pivots lever 66 out of contact with vertical shaft 22, and carriage 24 is thereby released for upward adjustment.

It is to be understood that the present invention is not limited to the sole embodiment described above, but encompasses any and all embodiments within the scope of the following claims.

We claim:

1. A jar lid opener for holding a jar having a lid therein and selectively screwing the lid on and off the jar, said jar lid opener comprising:

a base;

a platen rotatably mounted to said base;

powered drive means mounted to said base, said drive means including a motor, transmission means connecting motor output to and rotating said platen, and controls controlling motor operation;

stop means including:

a vertical shaft mounted to said base, a stop, and carriage means slidably mounting said stop on said vertical shaft, and braking means selectively opposing and enabling upward movement of said stop along said vertical shaft; and cam means urging said platen upwardly when rotating, whereby rotation of said platen urges a jar against said stop, thereby imposing a clamping force on a jar placed in said jar lid opener.

2. The jar lid opener according to claim 1, said platen further comprising:

guide means fixed to said base and projecting upwardly therefrom, said platen being slidably mounted and supported on said guide means, a plurality of plungers attached to and depending from said platen, said cam means comprising a circular track mounted on said base and below said platen, said track having a cammed upper surface including at least one high point, at least one low point, and inclined ramps providing transition between each one of said at least one high point and an adjacent one of said at least one low point, said plungers being constrained to ride on said cammed upper surface and supporting said platen thereon, said platen thereby raising when said plungers ascend one said ramp, whereby said platen is moved upwardly toward said stop, a jar placed on said platen thereby being urged upwardly against said stop with progressively increasing clamping force when said platen is rotated.

3. The jar lid opener according to claim 1, each one of said plungers being formed in two parts, there being a spring disposed therebetween urging said two parts apart.

4. The jar lid opener according to claim 1, said stop comprising:

a rigid member arranged in vertical registry above and with said platen, said rigid member also having a first liner made from a material having a high friction surface, and said platen having a second liner made from a material having a high friction surface.

5. A jar lid opener for holding a jar having a lid therein and selectively screwing the lid on and off the jar, said jar lid opener comprising:

a base;

a platen rotatably mounted to said base;

powered drive means mounted to said base, said drive means including a motor, transmission means connecting motor output to and rotating said platen, and controls controlling motor operation; stop means including:

a vertical shaft mounted to said base, a stop, and carriage means slidably mounting said stop on said vertical shaft, and braking means selectively opposing and enabling upward movement of said stop along said vertical shaft;

said vertical shaft having an outer surface and means defining a longitudinal groove formed in said outer surface; and said braking means further comprising:

a braking member supporting said carriage means, and engageable with said vertical shaft when said stop is urged upwardly along said vertical shaft, said stop being constrained against upward movement by binding of said braking member against said vertical shaft, a finger mounted on said braking member and riding in said groove, and means for biasing said finger to engage said vertical shaft when said stop moves upwardly therealong.

6. The jar lid opener according to claim 5, said braking means further comprising manual release means for disengaging said braking member from said vertical shaft, whereby said stop is moved upwardly along said vertical shaft without binding thereon.

7. A jar lid opener for holding a jar having a lid therein and selectively screwing the lid on and off the jar, said jar lid opener comprising:

a base, a platen rotatably mounted to said base, said platen further comprising guide means fixed to said base and projecting upwardly therefrom, said platen being slidably mounted and supported on said guide means, and a plurality of plungers attached to and depending from said platen, powered drive means mounted to said base, said drive means including a motor, transmission means connecting motor output to and rotating said platen, and controls controlling motor operation, stop means including:

a vertical shaft mounted to said base, a stop, and carriage means slidably mounting said stop on said vertical shaft, and braking means selectively opposing and enabling upward movement of said stop along said vertical shaft, and cam means urging said platen upwardly when rotating, said cam means comprising a circular track mounted on said base and below said platen, said track having a cammed upper surface including at least one high point, at least one low point, and inclined ramps providing transition between each one of said at least one high point and an adjacent one of said at least one low point, said plungers being constrained to ride on said cammed upper surface and supporting said platen thereon, said platen thereby raising when said plungers ascend one said ramp, whereby said platen is moved upwardly toward said stop, a jar placed on said platen thereby being urged upwardly against said stop with progressively increasing clamping force when said platen is rotated.

8. The jar lid opener according to claim 7, each one of said plungers being formed in two parts, there being a spring disposed therebetween urging said two parts apart.

9. The jar lid opener according to claim 7, said vertical shaft having an outer surface and means defining a longitudinal groove formed in said outer surface, said braking means further comprising:

a braking member mounted on said braking means and riding in said groove and being engageable with said vertical shaft when said stop is urged upwardly along said vertical shaft, said stop being constrained against upward movement by binding of said braking member against said vertical shaft, and means for biasing said braking member to engage said vertical shaft when said stop moves upwardly therealong.

10. The jar lid opener according to claim 9, said braking means further comprising manual release means for disengaging said finger from said vertical shaft, whereby said stop is moved upwardly along said vertical shaft without binding thereon.

11. The jar lid opener according to claim 7, said stop comprising:

a rigid member arranged in vertical registry above and with said platen, said rigid member also having a first liner made from a material having a high friction surface, and said platen having a second liner made from a material having a high friction surface.

* * * * *